US011297442B2

(12) United States Patent
Klose

(10) Patent No.: US 11,297,442 B2
(45) Date of Patent: Apr. 5, 2022

(54) MICROPHONE MODULE

(71) Applicant: VALEO Telematik und Akustik GmbH, Friedrichsdorf (DE)

(72) Inventor: Michael Klose, Créteil (FR)

(73) Assignee: VALEO TELEMATIK UND AKUSTIK GMBH, Friedrichsdorf (DE)

( * ) Notice: Subject to any disclaimer, the term of this patent is extended or adjusted under 35 U.S.C. 154(b) by 0 days.

(21) Appl. No.: 17/044,951

(22) PCT Filed: Apr. 4, 2019

(86) PCT No.: PCT/EP2019/058558
§ 371 (c)(1),
(2) Date: Oct. 2, 2020

(87) PCT Pub. No.: WO2019/193118
PCT Pub. Date: Oct. 10, 2019

(65) Prior Publication Data

US 2021/0029471 A1 Jan. 28, 2021

(30) Foreign Application Priority Data

Apr. 4, 2018 (DE) ..... 10 2018 107 898.6

(51) Int. Cl.
*H04R 19/04* (2006.01)
*H04R 1/08* (2006.01)
*H04R 19/00* (2006.01)

(52) U.S. Cl.
CPC ..... *H04R 19/04* (2013.01); *H04R 1/08* (2013.01); *H04R 19/005* (2013.01); *H04R 2201/003* (2013.01)

(58) Field of Classification Search
CPC ..... H04R 2499/11
See application file for complete search history.

(56) References Cited

U.S. PATENT DOCUMENTS 9,380,377 B2 * 6/2016 Jingming ..... H04R 1/02
2011/0158450 A1 * 6/2011 Tanaka ..... H04R 1/38 381/355

(Continued)

FOREIGN PATENT DOCUMENTS

CN 204968106 U * 1/2016
EP 2963946 A2 1/2016

OTHER PUBLICATIONS

International Search Report and Written Opinion in corresponding International Application No. PCT/EP2019/058558, dated Jul. 23, 2019 (8 pages).

*Primary Examiner* — Angelica M McKinney
(74) *Attorney, Agent, or Firm* — Osha Bergman Watanabe & Burton LLP

(57) ABSTRACT

A Microphone module (101) is disclosed which comprises a MEMS-microphone capsule (102), a PCB (103) and a sealing element (104), wherein the PCB (103) comprises on its top surface (108) a first groove (115) which opens at a first end (115*a*) into the first passage (109) and the PCB (103) further comprises on its top surface (108) a second groove (116) which opens at a first end (116*a*) into the second passage (110) and wherein the sealing element (104) is arranged on the top surface (108) of the PCB (103) and that the sealing element (104) covers the first groove (115) and the second groove (116) in such a way that the first groove (115) is transformed into a first channel (117) and the second grove (116) is transformed into a second channel (118).

13 Claims, 1 Drawing Sheet

(56) References Cited

U.S. PATENT DOCUMENTS

2012/0250897 A1* 10/2012 Michel ..... H04R 19/04
381/111
2016/0007107 A1* 1/2016 Reese ..... H04R 1/08
381/174

* cited by examiner

MICROPHONE MODULE

BACKGROUND OF THE INVENTION

Field of the Invention

The present invention relates to a microphone module.

Description of Related Art

A microphone module according to the state of the art (shown in FIG. 1) comprises a MEMS-microphone capsule, a PCB and a sealing element, wherein the sealing element comprises a first vent and a second vent, wherein the PCB is arranged between the MEMS-microphone capsule and the sealing element, wherein the PCB comprises a bottom surface and a top surface, wherein the MEMS-microphone capsule is aligned to the bottom surface of the PCB, wherein the PCB comprises a first passage for sound and a second passage for sound, wherein an outlet of the first passage matches with a first inlet of sound of the MEMS-microphone capsule and an outlet of the second passage matches with a second inlet of sound of the MEMS-microphone capsule and wherein the microphone module comprises an additional building component between the PCB and the sealing element which comprises channels serving as ducts between the vents of the sealing element and the passages of the PCB.

SUMMARY OF THE INVENTION

The object of the invention is to provide a simplified design of the microphone module while maintaining the acoustic characteristics of the microphone module.

The inventive microphone module comprises a PCB which comprises on its top surface a first groove which opens at a first end into the first passage and the PCB further comprises on its top surface a second groove which opens at a first end into the second passage and the sealing element is arranged on the top surface of the PCB and covers the first groove and the second groove in such a way that the first groove is transformed into a first channel and the second grove is transformed into a second channel.

By using a PCB with grooves and by using the sealing element as cover for the grooves the additional building component is superfluous. This means that the number of parts or components of the microphone module, the assembly work and the overall height of the microphone module is reduced. According to this, the microphone module may be produced at lower cost but with unchanged acoustic characteristics.

Provision is made that the first vent opens to a second end of the first groove and the second vent opens to second end of the second groove. By such an arrangement sound has to pass through the first channel and the second channel, respectively in order to reach the MEMS-microphone capsule.

Provision is further made that the first vent is arranged in an offset with respect to the first passage of the PCB and the second vent is arranged in an offset with respect to the second passage of the PCB. By such an arrangement it is possible to manipulate the distance which the sound has to pass through the first channel respectively through the second channel.

Provision is also made that the first vent and the second vent of the sealing element is covered either by a single protection and/or friction element or are covered by a first protection and/or friction element and a second protection and/or friction element. By such an arrangement it is possible to protect the channels from dust and moisture and/or to influence the acoustic properties and especially influence the directional characteristics of the microphone module.

According to the invention MEMS-microphone capsule is a SMD component which is fixed to a PCB and especially comprises two acoustic inlets.

DETAILED DESCRIPTION OF THE INVENTION

Figure 1:
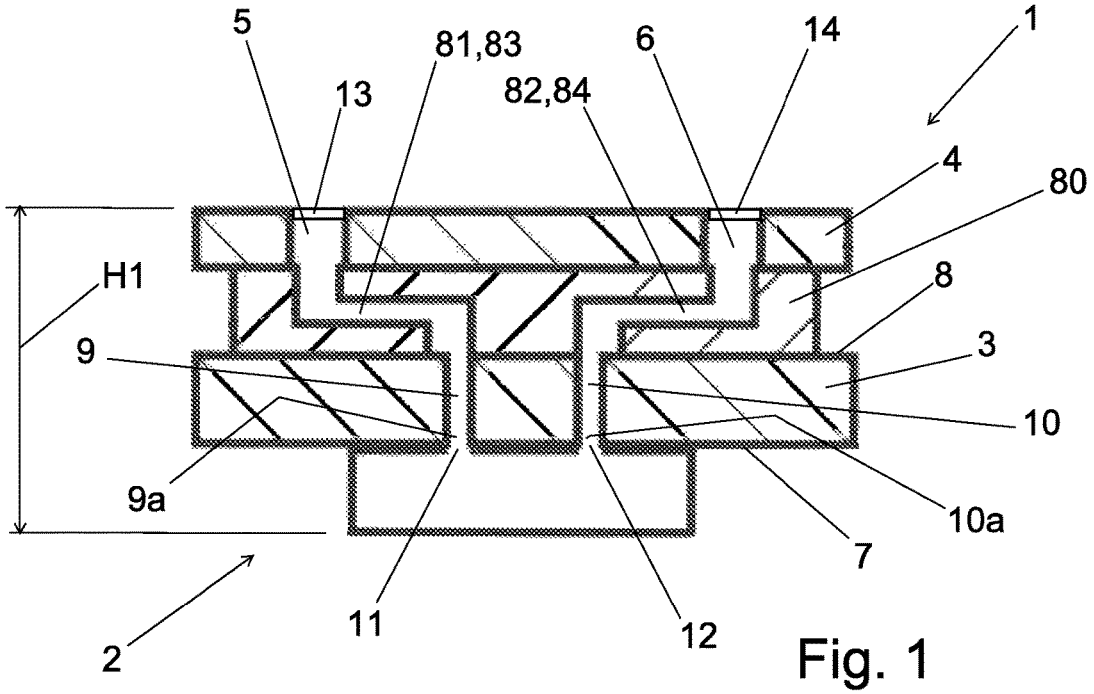
FIG. 1: shows a cross-sectional view of a microphone module according to the state of the art

FIG. 1 shows in a cross-sectional view a microphone module 1 according to the state of the art wherein the view only shows the lines which lie in a cutting plane. The known microphone module 1 comprises a MEMS-microphone capsule 2, a printed circuit board (PCB) 3 and a sealing element 4. The sealing element 4 comprises a first vent 5 and a second vent 6. The PCB 3 is arranged between the MEMS-microphone capsule 2 and the sealing element 4. The PCB comprises a bottom surface 7 and a top surface 8. The MEMS-microphone capsule 2 is aligned to the bottom surface 7 of the PCB 3. The PCB 3 comprises a first passage 9 for sound and a second passage 10 for sound. An outlet 9*a* of the first passage 9 matches with a first inlet 11 of sound of the MEMS-microphone capsule 2 and an outlet 10*a* of the second passage 10 matches with a second inlet 12 of sound of the MEMS-microphone capsule 2. The first vent 5 and the second vent 6 of the sealing element 4 is covered respectively sealed by a first protection and/or friction element 13 and by a second protection and/or friction element 14.

The known microphone module 1 comprises an additional building component 80 which is arranged between the PCB 3 and the sealing element 4. The building component 80 comprises channels 81, 82 which run parallel to the top surface 8 of the PCB 3. These channels 81, 82 serve as ducts 83, 84 between the vents 5, 6 of the sealing element 4 and the passages 9, 10 of the PCB 3.

Figure 2:
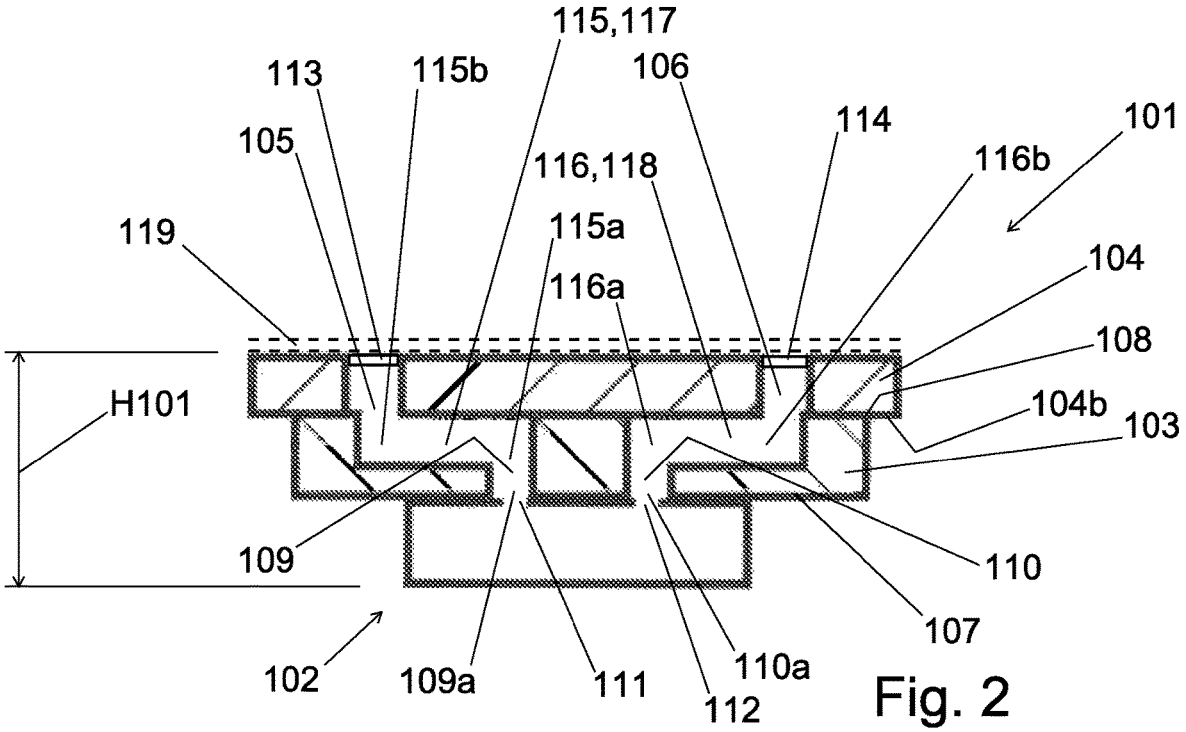
FIG. 2: shows a cross-sectional view of a microphone module according to the invention.

FIG. 2 shows in a cross-sectional view a microphone module 101 according to the invention wherein the view shows only the lines which lie in a cutting plane. The microphone module 101 comprises a MEMS-microphone capsule 102, a PCB 103 and a sealing element 104. The sealing element 104 comprises a first vent 105 and a second vent 106. The PCB 103 is arranged between the MEMS-microphone capsule 102 and the sealing element 104. The PCB comprises a bottom surface 107 and a top surface 108. The MEMS-microphone capsule 102 is aligned to the bottom surface 107 of the PCB 103. The PCB 103 comprises a first passage 109 for sound and a second passage 110 for sound. An outlet 109*a* of the first passage 109 matches with a first inlet 111 of sound of the MEMS-microphone capsule 102 and an outlet 110*a* of the second passage 110 matches with a second inlet 112 of sound of the MEMS-microphone capsule 102. The first vent 105 and the second vent 106 of the sealing element 104 is covered respectively sealed by a first protection and/or friction element 113 and by a second protection and/or friction element 114. Wherein the elements 113, 114 have identical or different characteristics. A bottom face 104*b* of the sealing element is designed as a flat surface.

According to the invention, the PCB 103 comprises on its top surface 108 a first groove 115 which opens at a first end 115*a* into the first passage 109 and the PCB 103 comprises on its top surface 108 a second groove 116 which opens at a first end 116*a* into the second passage 110. The said sealing element 104 is fixed to the top surface 108 of the PCB 103 and covers the first groove 115 and the second groove 116 in such a way that the first groove 115 is transformed into a first acoustic channel 117 and that the second grove 116 is transformed into a second acoustic channel 118.

The first vent 105 of the sealing element 104 opens to a second end 115*b* of the first groove 115 and the second vent 106 opens to second end 116*b* of the second groove 116. The passage 109, 110 and the vents 105, 106 run perpendicular to the grooves 115, 116 respectively to the channels 117, 118. In a view on the top surface 108 of the PCB 3 the first vent 105 of the sealing element 104 is arranged offset with respect to the first passage 109 of the PCB 103 and the second vent 106 of the sealing element 104 is arranged offset with respect to the second passage 110 of the PCB 103. In other words a distance between the vents 105, 106 is larger than a distance between the first and the second inlet 111, 112 or a distance between first passage and the second passage 109, 110.

According to a variant of the invention the vents 105, 106 are not protected or covered by the protection and/or friction elements 113 or 114 but are protected or covered by a single protection and/or friction element 119. The protection and/or friction element 119 is shown in FIG. 2 by a rectangle printed in dotted lines.

The MEMS-microphone capsule 102 comprises two acoustic inlets namely the first inlet 111 and the second inlet 112. Hereby the MEMS-microphone capsule 102 is typically used as an unidirectional MEMS-microphone capsule or as a bidirectional MEMS-microphone capsule.

An overall height H101 of the inventive microphone module 101 measured perpendicular to the top surface 108 of the PCB 103 is smaller and especially 20% smaller than an overall height H1 of the microphone module 1 according to the state of the art.

According to an embodiment of the microphone module the bottom surface of the sealing element 104 is a self-adhesive surface in order to facilitate the assembly of the sealing element 104 and the PCB 103. Additionally or alternatively the protection and/or friction elements 113, 114 respectively the protection and/or friction element 119 is provided as self-adhesive in order to facilitate the assembly of the protection and/or friction element (s) and the sealing element 104.

According to an embodiment of the microphone module the sealing element 104 and the protection and/or friction elements 113, 114 respectively the sealing element 104 and the protection and/or friction element 119 are provided as a preassembled element or a one-piece element of a felt fabric or a mesh structure with a self-adhesive bottom surface 104*b*.

LIST OF REFERENCE SYMBOLS

1 microphone module
2 MEMS-microphone capsule
3 PCB (printed circuit board)
4 sealing element
5 first vent of 4
6 second vent of 4
7 bottom surface of 3
8 top surface of 3
9 first passage of 3
9*a* outlet of 9
10 second passage of 3
10*a* outlet of 10
11 first inlet of 2
12 second inlet of 2
13 protection and/or friction element for 5
14 protection and/or friction element for 6
80 additional building component of 1
81, 82 channel of 80
83, 84 duct of 80
H1 overall height of 1
101 microphone module
102 MEMS-microphone capsule
103 PCB
104 sealing element
104*b* bottom surface of 104
105 first vent of 104
106 second vent of 104
107 bottom surface of 103
108 top surface of 103
109 first passage of 103
109*a* outlet of 109
110 second passage of 103
110*a* outlet of 110
111 first inlet of 102
112 second inlet of 102
113 protection and/or friction element for 105
114 protection and/or friction element for 106
115 first groove of 103
115*a* first end of 115
115*b* second end of 115
116 second groove of 103
116*a* first end of 116
116*b* second end of 116
117 first channel between 103 and 104
118 second channel between 103 and 104
119 protection and/or friction element (alternative design)
H101 overall height of 101

The invention claimed is:

1. A microphone module comprising:

a micro-electromechanical systems (MEMS) microphone capsule;

a printed circuit board (PCB) comprising a top surface and a bottom surface; and a sealing element comprising a first vent and a second vent, wherein:

the PCB is arranged between the MEMS-microphone capsule and the sealing element, the MEMS-microphone capsule is aligned to the bottom surface of the PCB, the PCB comprises a first passage for sound and a second passage for sound, an outlet of the first passage matches with a first inlet of sound of the MEMS-microphone capsule and an outlet of the second passage matches with a second inlet of sound of the MEMS-microphone capsule, the PCB comprises:

a first groove which is recessed into the top surface and opens at a first end into the first passage, and a second groove which is recessed into the top surface and opens at a first end into the second passage, and the sealing element is fixed to the top surface of the PCB, wherein the sealing element covers the first groove and the second groove, and transforms the first groove into a first acoustic channel and the second groove into a second acoustic channel.

2. The microphone module according to claim 1, wherein the first vent opens to a second end of the first groove and the second vent opens to a second end of the second groove.

3. The microphone module according to claim 2, wherein the first vent is arranged offset with respect to the first passage of the PCB and the second vent is arranged offset with respect to the second passage of the PCB.

4. The microphone module according to claim 3, wherein the first and second grooves run parallel to the top surface of the PCB.

5. The microphone module according to claim 3, wherein:

the first groove runs perpendicular to the first vent and the first passage; and the second groove runs perpendicular to the second vent and the second passage.

6. The microphone module according to claim 2, wherein the first and second grooves run parallel to the top surface of the PCB.

7. The microphone module according to claim 2, wherein:

the first groove runs perpendicular to the first vent and the first passage; and the second groove runs perpendicular to the second vent and the second passage.

8. The microphone module according to claim 1, wherein the first vent and the second vent of the sealing element is covered by a single protection and/or friction element or are covered by a first protection and/or friction element and a second protection and/or friction element.

9. The microphone module according to claim 8, wherein the first and second grooves run parallel to the top surface of the PCB.

10. The microphone module according to claim 8, wherein:

the first groove runs perpendicular to the first vent and the first passage; and the second groove runs perpendicular to the second vent and the second passage.

11. The microphone module according to claim 1, wherein the first and second grooves run parallel to the top surface of the PCB.

12. The microphone module according to claim 1, wherein:

the first groove runs perpendicular to the first vent and the first passage; and the second groove runs perpendicular to the second vent and the second passage.

13. The microphone module according to claim 12, wherein the first and second grooves run parallel to the top surface of the PCB.

* * * * *